US006433673B1

(12) United States Patent
Yin et al.

(10) Patent No.: US 6,433,673 B1
(45) **Date of Patent: *Aug. 13, 2002**

(54) DIGITAL ENUNCIATOR, PROCESS AND COMMUNICATION SYSTEM EMPLOYING SAME

(75) Inventors: Ning Yin, Costa Mesa; Romy Reyes, Diamond Bar; Kenneth Scott Walley, Portola Hills, all of CA (US)

(73) Assignee: Conexant Systems, Inc., Newport Beach, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 107 days.

(21) Appl. No.: 09/160,677

(22) Filed: Sep. 25, 1998

(51) Int. Cl.[7] ..... G08B 3/10

(52) U.S. Cl. ..... 340/384.4; 340/384.7; 340/870.12; 340/870.26; 84/694; 84/169; 384/104; 384/107; 455/200.1; 455/233.1; 455/267

(58) Field of Search ..... 340/384.4, 384.7, 340/870.12, 870.26, 311; 84/674, 694, 169; 455/200.1, 233.1, 267; 381/104, 107

(56) References Cited

U.S. PATENT DOCUMENTS

| | | | | |
|---|---|---|---|---|
| 4,000,468 A | | 12/1976 | Brown et al. | 325/335 |
| 4,028,500 A | | 6/1977 | McClure et al. | 179/41 A |
| 4,363,028 A | | 12/1982 | Bosnak | 340/384.4 |
| 4,389,638 A | | 6/1983 | Gontowski | 340/384.4 |
| 4,539,884 A | * | 9/1985 | Acki | 84/1.24 |
| 5,732,330 A | | 3/1998 | Anderson et al. | |
| 5,757,267 A | | 5/1998 | Xydis | 340/539 |
| 5,796,852 A | | 8/1998 | Yamaguchi | 381/104 |

FOREIGN PATENT DOCUMENTS

| | | | |
|---|---|---|---|
| EP | 0 257 687 | * | 3/1988 |
| EP | 0 265 064 | | 4/1988 |
| EP | 0 493 973 | | 7/1992 |

OTHER PUBLICATIONS

International Search Report dated Jan. 25, 2000.

* cited by examiner

*Primary Examiner*—Julie Lieu
(74) *Attorney, Agent, or Firm*—Foley & Lardner

(57) ABSTRACT

A receiver in a communication system is coupled to a transmission channel for receiving communication signals transmitted over a transmission channel. The receiver includes signal receiving electronics for receiving communication signals directed to the receiver. The receiver also includes a controller, responsive to the receipt of a communication signal by the signal receiving electronics, to provide an enunciator enable signal, and a clock signal generator for generating a clock signal. The receiver further includes an enunciator coupled to the clock signal generator, for producing an electronic sound signal. The enunciator includes a volume control module for receiving a first periodic signal and providing a volume control signal. The enunciator also includes a divider for receiving the clock signal and providing a corresponding output signal having a frequency corresponding to the frequency of the clock signal frequency divided by a divider value. The enunciator further includes a tone control module coupled to the divider, for providing a tone control signal having a specified frequency and overtone pattern, and a modulator for modulating the third periodic signal by the second periodic signal to provide an electronic sound signal.

17 Claims, 4 Drawing Sheets

DIGITAL ENUNCIATOR, PROCESS AND COMMUNICATION SYSTEM EMPLOYING SAME

FIELD OF THE INVENTION

The present invention relates, generally, to communication systems and processes which use digital enunciators and to digital annunciator devices and processes and, in particular embodiments, to such systems, processes and devices which produce an electronic sound signal from a clock signal input.

DESCRIPTION OF THE RELATED ART

Electronic communication has become a part of many aspects of personal, business, military and other activities and tasks. As the popularity of various electronic communication devices increases, for example, personal communication devices such as cellular telephones, personal pagers, cordless telephones or the like, the demand for smaller, lighter, more power-efficient electronics increases. One way to minimize size, weight and power consumption is to employ electronic circuit configurations which minimize the number components that require significant space and power.

Many modern electronic communication devices include a number of electronic circuits for performing a variety of functions related (or ancillary) to communication functions. For example, many modern communication devices include enunciator or tone generator circuits for providing electronic sound signals to a sound producing device, such as a speaker, to generate audible tones. Thus, in the context of a telephone communication system or a pager communication system, telephone or pager receiver units are typically provided with enunciator or tone generator electronics which are activated to generate electronic sound signals when a call is received by a telephone or pager unit, to notify the user of the receipt of the call.

In some conventional devices, the enunciator generates a single, repeating tone signal, which, when provided to a speaker or other sound producing device, produces a sound heard by the user as a repeating tone or series of beeps. However, other conventional devices have been provided with programmed or programmable tone generator and music synthesizer circuits implemented in CODEC devices with one or more signal generators for generating predefined electronic sound signal waveforms and/or with memory devices of capacities capable of storing data representing such waveforms. Such devices can provide more complex musical sounds and musical arrangements of tones, for example, a series of notes or chords, a portion of a song or the like. However, such CODEC devices can be relatively complex and expensive, and can require a substantial amount of power.

In many popular applications, communication systems include portable or remote transmitting or receiving units that, in some instances, operate on limited power supplies, such as battery packs or the like, and/or are designed to be portable and stowable. For example, cellular telephone systems include cellular telephone transmitter/receiver units which, typically, operate on limited battery power and which are often designed to be carried in a compact space, such as a pocket, briefcase, purse or the like. Similarly, cordless telephone systems include cordless transmitter/receiver units which operate on a rechargeable battery and which are designed to be relatively light-weight and portable. It is typically desirable to minimize size, weight and power consumption requirements of such portable or remote units and components thereof. Of course, other communication systems would also benefit by minimizing size, weight and power consumption requirements.

SUMMARY OF THE DISCLOSURE

Accordingly, preferred embodiments of the present invention address the above-noted industry needs by employing an enunciator arrangement with minimal the size, cost and power consumption requirements.

Embodiments of the present invention relate, generally, to communication systems and processes which use digital enunciators, and digital enunciator devices and processes. In preferred embodiments, an enunciator on a receiving (or transmitting/receiving) unit operates with an on-board clock to produce a sound signal and allows for programmable control of the notes and overtone patterns associated with the sound signal. In further preferred embodiments, the enunciator is configured with minimal components coupled to operate with processor and clock generating devices shared with other components of the receiving unit, thus avoiding the need for additional processor and clock generating components to perform the programmable enunciator functions.

According to one preferred embodiment, a receiver in a communication system is coupled to a transmission channel for receiving communication signals transmitted over a transmission channel. The receiver includes signal receiving electronics for receiving communication signals directed to the receiver. The receiver also includes a controller, responsive to the receipt of a communication signal by the signal receiving electronics, to provide an enunciator enable signal, and a clock signal generator for generating a clock signal. The receiver further includes an enunciator coupled to the clock signal generator, for producing an electronic sound signal.

The enunciator includes a volume control module for receiving a clock signal and providing a volume control signal. The enunciator also includes a divider for receiving the clock signal and providing a corresponding output signal having a frequency corresponding to the frequency of the clock signal frequency divided by a divider value. The enunciator further includes a tone control module coupled to the divider, for providing a tone control signal having a specified frequency and overtone pattern, and a modulator for modulating the output of the tone control signal by the volume control signal to provide an electronic sound signal.

DETAILED DESCRIPTION OF PREFERRED EMBODIMENTS

Embodiments of the present invention relate, generally, to communication systems and processes which use digital enunciators, and digital enunciator devices and processes. In preferred embodiments, an enunciator on a receiving (or transmitting/receiving) unit operates with an on-board clock to produce a digital sound signal and allows for programmable control of the notes and overtone patterns associated with the sound signal. In further preferred embodiments, the enunciator is configured with minimal components coupled to operate with processor and clock generating devices shared with other components of the receiving unit, thus avoiding the need for additional processor and clock generating components to perform the programmable enunciator functions.

Digital enunciators and processes according to embodiments of the present invention may be employed in a variety of communications systems, including systems employing wireless communication channels as well as systems employing electrically conductive, optical or hybrid channels. Thus, embodiments of the invention described herein may involve various forms of communications systems. However, for purposes of simplifying the present disclosure, preferred embodiments of the present invention are described herein, in relation to personal wireless communications systems, including, but not limited to digital mobile telephones, digital cordless telephones, digital pagers, combinations thereof, and the like.

Such personal communication systems typically include one or more portable or remotely located receiver and/or transmitter units. In many applications, such portable or remote units operate with limited power supplies, for example, a rechargeable or replaceable battery. Accordingly, preferred embodiments of the present invention involve digital enunciators and communication systems and devices with such enunciators, which are configured for minimizing power requirements, size, weight and cost, of such receiver/transmitter units, for example, to improve portability and increase usage time between power recharges.

Figure 1:
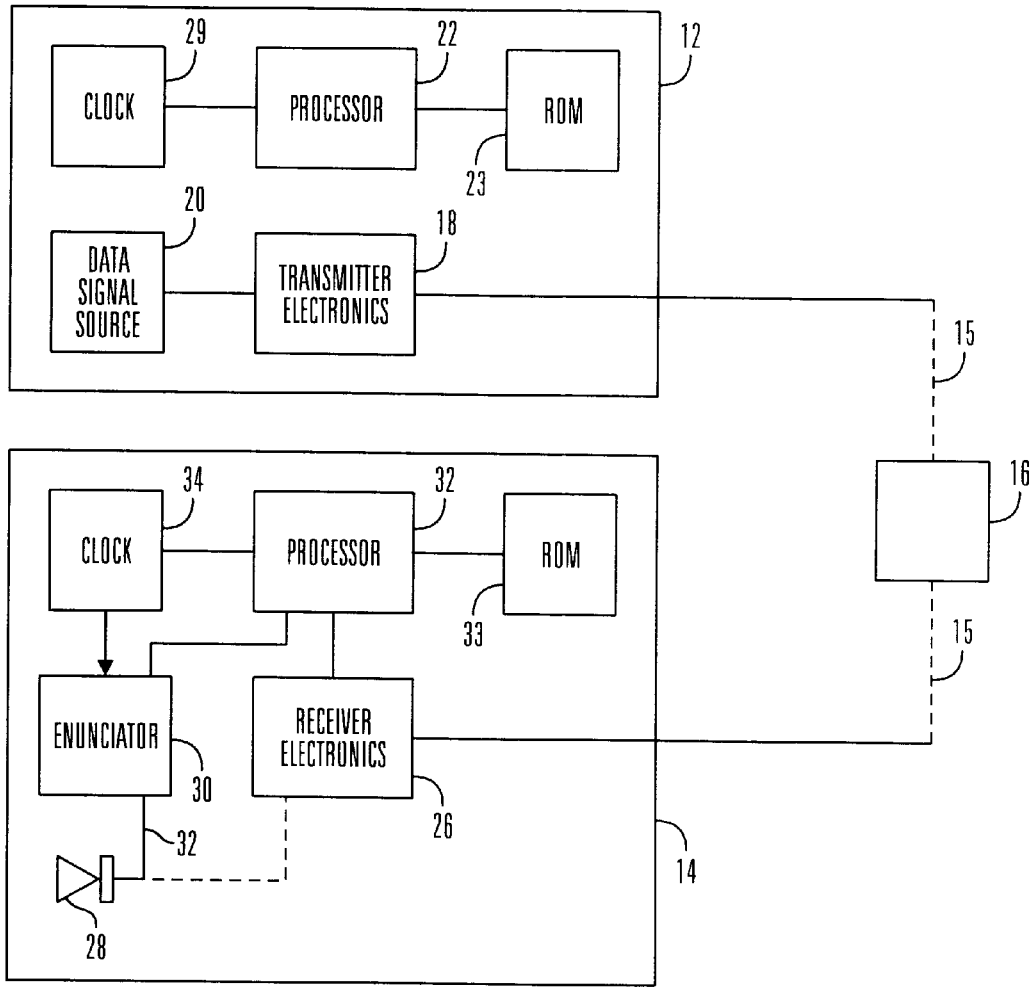
FIG. 1 is a block diagram representation of a system environment according to an example embodiment of the present invention.

A generalized representation of a communication system environment of an embodiment of the present invention is shown in FIG. 1, wherein a communication system 10 includes a transmitting unit 12 and a receiving unit 14, coupled for communication over a communication channel 15. In one system embodiment, the units 12 and 14 transmit and receive signals directly therebetween. In other system embodiments, the units 12 and 14 communicate through one or more additional transmitter/receiver configurations (such as repeater, base or cell stations), generally represented as reference character 16 in FIG. 1.

According to preferred two-way communication system embodiments, such as, for example, cellular telephone embodiments or cordless telephone embodiments, each unit 12 and 14 is configured with both receiver and transmitter components, to function as both a transmitting unit and a receiving unit. In one-way communication systems embodiments, such as, for example, pager system embodiments, the receiving unit need only contain receiver components and the transmitting unit need only contain transmitter components. For purposes of simplifying the present disclosure, the transmitting unit 12 is shown in FIG. 1 with transmitting components and the receiving unit 14 is shown in FIG. 1 with receiving components. However, it will be understood that, for two-way communication system embodiments, unit 12 may also include receiving components for functioning as a receiving unit and, similarly, unit 14 may also include transmitting components for functioning as a transmitting unit.

The transmitting unit 12 includes transmitting electronics 18 connected to receive a data signal from a data signal source 20. The transmitting electronics may comprise any suitable transmitting means capable of receiving a data signal and transmitting a signal corresponding to the data signal over the communication channel 15. Various forms of transmitting electronics are within the scope of knowledge of those skilled in the art and are, therefore, not discussed in detail herein for purposes of simplifying the present disclosure.

The data source 18 may include any suitable device for producing electronic data signals for communication over the channel 15, such as, but not limited to, a microphone and amplifier circuit, a voice encoder, a keyboard, a mouse or other user input device, a sensor, monitor or testing apparatus, or the like. In one representative embodiment, the data signal source may include, for example, a microphone for converting sound waves into electronic signals and sampling electronics for sampling and converting the electronic signals into digital signals representative of the sound waves.

The receiving unit 14 includes receiver electronics 26 connected to receive a data signal transmitted over the communication channel 15 and provide a signal corresponding to the received data signal to an audio device, visual display device memory device or the like, depending upon the system application. In the FIG. 1 embodiment, the receiver electronics 26 is coupled to provide an audio signal to a audio device, such as a speaker 28.

The receiver electronics may comprise any suitable signal receiving means capable of receiving a signal on the communication channel 15 and providing an audio, video or other data signal corresponding to the received signal. Signal receiving electronics technology is within the scope of knowledge of those skilled in the art and is, therefore, not discussed in detail herein for purposes of simplifying the present disclosure. The transmitter and receiver units include further components, power supplies, and the like, well known in the art for effecting transmission and reception of signals and for carrying out other functions specific to the application of use of the system.

In many modern communication system applications, transmitter and receiver units are provided with digital electronics, including digital processors for controlling various functions related or ancillary to the communication function (for example, to control transmitter or receiver functions and/or display functions, memory functions and the like). In this regard, the transmitting unit 12 and the receiving unit 14 in FIG. 1, each include a processor 22 or 32 coupled to the transmitter electronics 18 or receiver electronics 26. The processors 22 and 32 operate with program and/or data files stored in suitable memory devices, for example read only memory (ROM) devices 23 and 33, respectively.

Digital electronics, such as processors 22 and 32, typically operate with a clock or reference clock signal generated, for example, by a high frequency (Mhz) clock signal generator. A clock signal generator 24 is shown in FIG. 1, for providing a clock signal to the processor electronics, in accordance with well known digital processor technology. Similarly, the receiving unit 14 in FIG. 1 includes a processor 32 and a clock signal generator 34.

The receiving unit 14 shown in FIG. 1 further includes an enunciator circuit 30 for producing an electronic signal 32 for generating an audible sound from the speaker 28. The enunciator circuit 30 is controlled to produce an electronic signal, for example, upon the receipt of a message or communication call on the communication channel 15, to notify a user of the receipt of the message or call. Thus, for example, in the context of a telephone communication system or a pager communication system, the enunciator is activated to generate an audible sound, in response to the receipt of a telephone or pager call, to notify the user of the receipt of the call. In this regard, the receiving unit 14 is provided with suitable control electronics (for example, processor 32 in FIG. 1), for controlling the activation of the enunciator in response to the detection of a message or communication call directed to the receiving unit.

Figure 2:
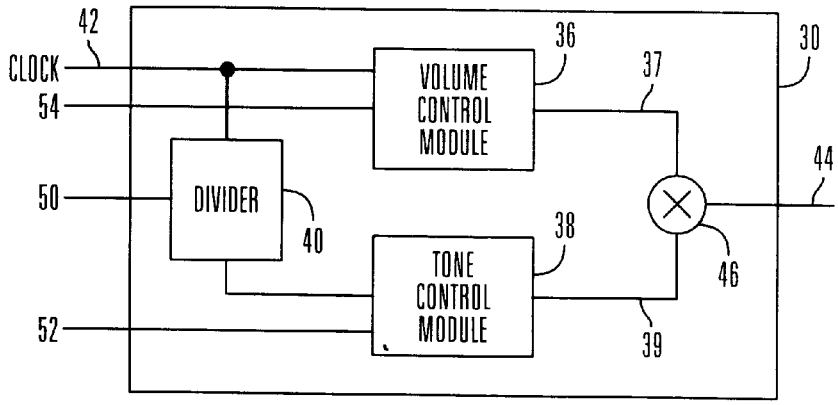
FIG. 2 is a block diagram representation of an enunciator according to an embodiment of the present invention.

A generalized box diagram representation of components of an enunciator 30 according to an embodiment of the present invention is shown in FIG. 2. The enunciator 30 includes a volume control module 36, a tone control module 38 and a frequency divider 40. The enunciator receives clock signal at a clock signal input 42 and provides a sound signal at output 44 to a suitable sound producing device, for example, the speaker 28 (FIG. 1). Various components of the enunciator are coupled to receive control signals from, for example, processor 32 (FIG. 1).

The clock input 42 of the enunciator 30 is coupled to an input of the volume control module 36 and to an input of the divider 40. The output of the divider 40 is coupled to an input of the tone control module 38. The output of the tone control module 38 is coupled to a first input of a multiplier 46. The output of the volume control module 36 is coupled to a second input of the multiplier 46. The output of the multiplier 46 is coupled to or defines the enunciator output 44.

As described in more detail below, with the use of a clock signal at input 42 (for example, from the clock 34 of FIG. 1), the enunciator 30 generates sound signals at output 44 to provide to a sound producing device (for example, the speaker 28 of FIG. 1). Moreover, the enunciator receives control signals (for example, from the processor 32 of FIG. 1) for allowing programmable control of the fundamental frequencies and overtone patterns of the sound signal at the output, to provide programmable control of the note or notes produced from the sound signal by the sound producing device (speaker 28).

Figure 3:
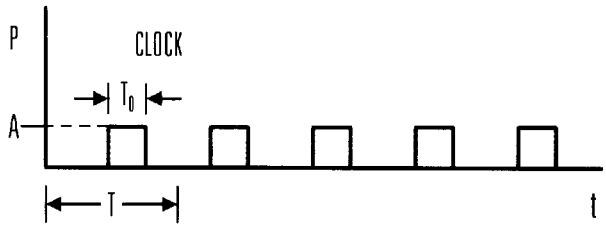
FIG. 3 is a graphical representation of a clock signal in the time domain.
Figure 4:
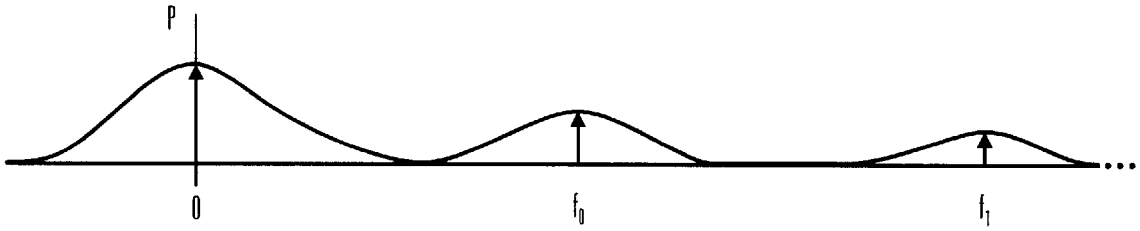
FIG. 4 is a graphical representation of a clock signal in the frequency domain.

The clock signal may be provided by any suitable clock signal generating device, the technology for which is within the scope of those skilled in the art. The clock signal generator provides a digital clock signal, for example, in the Mhz frequency range, such as used to operate typical digital processor electronics. In one example embodiment, the digital clock signal, when represented in the time domain, may be a square wave signal as shown in the FIG. 3 diagram of signal power level versus time. In the frequency domain, a clock signal may be represented as shown in FIG. 4 diagram of signal power level versus frequency. The frequency domain waveform generally comprises a Forrier transform of the time domain waveform.

In the time domain (FIG. 3), the clock signal is pulse train defining a frequency and a duty cycle. The duty cycle t corresponds to the ratio, in any one period or cycle of the signal, of the time portion $T_0$ at which the signal is at a high power level A, to the period T of the clock signal (or $t=T_0/T$). Frequency and duty cycle characteristics are also represented in the frequency domain waveform (FIG. 4) as the fundamental frequency $f_0$ and the pattern of harmonics frequencies $f_1$, $f_2$ . . . $f_n$ (or overtone pattern) of the waveform, respectively. The fundamental frequency $f_0=2\pi/T$. The amplitude of the waveform at the fundamental frequency $f_0$ is determined by:

$$\frac{A}{f_0}\sin(\tau f_0), \text{ where } \tau \text{ is the duty cycle.}$$

The enunciator 30 receives a clock signal at clock input 42, and employs its frequency and overtone characteristics to generate an electronic sound signal at output 44. In this manner, preferred embodiments of the present invention avoid the need for complex, power consuming signal generators or large memory capacities for generating or storing sound signals. As shown in the FIG. 2 embodiment, the clock signal at the input 42 is provided to the volume control module 36. The volume control module 36 outputs a volume (or amplitude) signal 37 for controlling the volume (or amplitude) of the sound signal produced by the enunciator 30.

The clock signal at input 42 is also provided to the divider 40, the output of which is provided to the tone control module, for producing a tone signal 39. The tone signal 39 determines the tonal qualities of the electronic sound signal generated by the enunciator 30. The volume signal 37 and the tone signal 39 are multiplied (or convoluted a volume factor defined by the amplitude of the volume signal 37, to produce an electronic sound signal at the output 44.

In preferred embodiments, the volume control module 36, tone control module 38 and the divider 40 are provided with program or control signals from suitable control electronics. For example, the processor 32 may be controlled by suitable programs stored in ROM 33 to provide such program or control signals.

The programmable divider is provided with a divider value control signal 50 for controlling the factor by which the divider divides the input clock signal frequency. As described above, in one preferred embodiment, the input clock signal is provided by a clock generator shared by other digital electronics on the receiving unit 14, such as the processor 32 (FIG. 1). The high frequency signal (typically in the MHz range) produced by such clock generators is divided down to a frequency within the hearing range of an average human (for example, within the range of about 20 Hz to about 20 KHz). The output signal of the divider, thereby, defines a fundamental frequency $f_0$ corresponding to an audible tone or note.

By changing the divider value (with control signal 50) one or more times over a period of time, the fundamental frequency $f_0$ and, thus, the tone or note defined by the output of the divider 40 may be changed a corresponding number of times during the time period. In this manner, the divider 50 may be controlled to convert the input clock signal into a divider output signal corresponding to a plurality (or series) of tones or notes, for example, in a musical arrangement.

The harmonics $f_1$, $f_2$ . . . $f_n$ of the output signal of the divider define an overtone pattern. The tone control module 38 processes the overtone pattern of the divider output signal. The tone control module 38 is provided with a tone control (or data pattern control) signal 52 to control the overtone pattern of the signal from the divider. The tone signal 39 output from the tone control module defines a fundamental frequency $f_0$ determined by the divider value for the divider 50 and an overtone pattern controlled by the data pattern control signal.

The volume control module 36 receives a volume control signal 54 for determining the volume (or amplitude) defined by the volume signal 37. The volume control signal 54 controls the pulse width of the volume signal 37. When the volume signal 37 is used to modulate the tone signal 39, as discussed below, the pulse width (and, thus, the duty cycle) of the volume signal 37 controls the amplitude of the resulting modulated signal 44 and, thus, controls the volume associated with the modulated signal 44.

Figure 5:
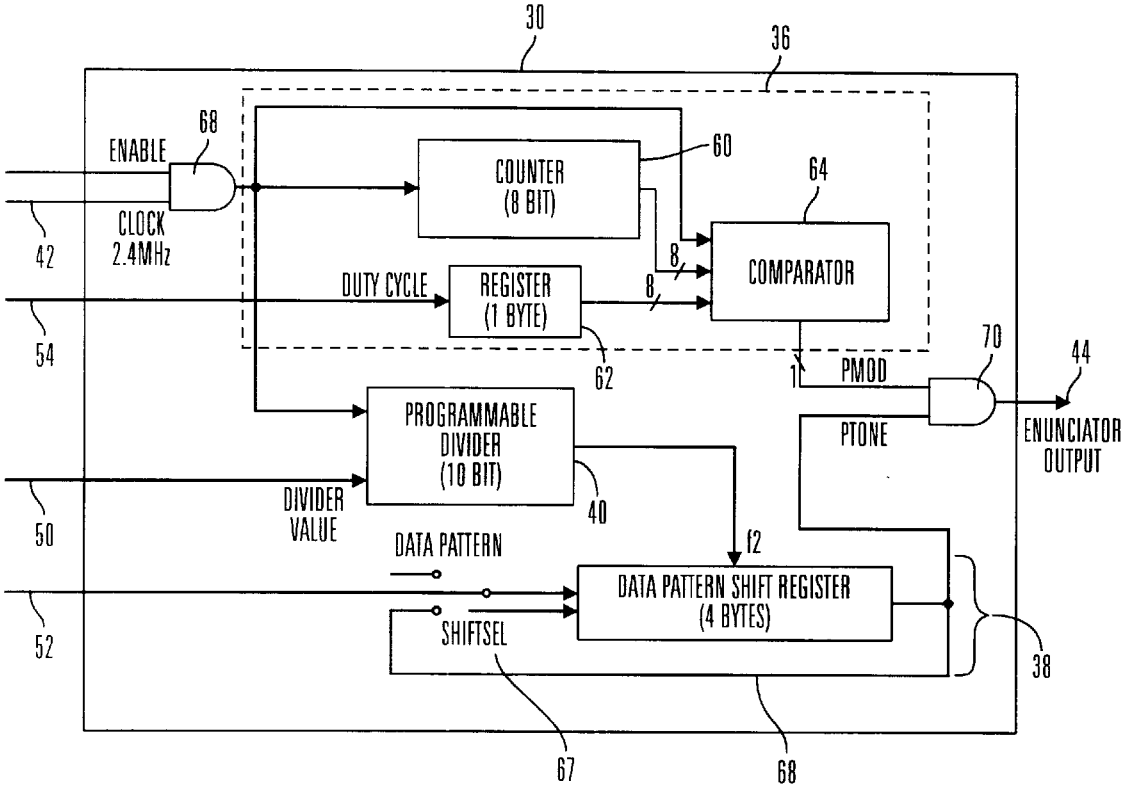
FIG. 5 is a more detailed block diagram of the enunciator of FIG. 2, according to a preferred embodiment of the present invention.

A more detailed diagram of an enunciator 30 according to a preferred embodiment of the present invention is shown in FIG. 5. The enunciator shown in FIG. 5 includes a volume control module 36, a tone control module 38 and a divider 40 as discussed above with reference to FIG. 3. In the FIG. 5 embodiment, the volume control composed of a counter 60, a register 62 and a comparator 64. The tone control module 38 in FIG. 5 includes a data pattern shift register 66.

The clock signal input 42 of the enunciator 30 in FIG. 5 is provided to an input terminal of an AND gate 68. The other input terminal of the AND gate 68 is provided an enable signal from suitable control electronics (such as a processor 32 under the control of a program, for example, stored in ROM 33 and variables preferably stored in a programmable memory, such as random access memory RAM, not shown, associated with the processor) in response to the detection or receipt of an incoming message or call to the receiving unit (14 in FIG. 1) in which the enunciator resides. In this manner, the AND gate 68 provides a clock signal output, upon receiving both the enable signal input and the clock signal input.

The clock signal output of the AND gate 68 is provided as inputs to the counter 60, the comparator 64 and the divider 40. The output of the counter 60 is provided, in parallel, as further inputs to the comparator 64. The register 62 receives a duty cycle signal as control input 54 from the processor 32 under the control of a suitable program, for example, stored in ROM 33. The register 62 also provides its output, in parallel, as further inputs to the comparator 64. The output of the comparator 64 is coupled, as the output of the volume control module 36, to one of the inputs of a second AND gate 70. The other input of the AND gate 70 is coupled to the output of the shift register 66 of the tone control module 38. In this manner, the AND gate 70 operates as a multiplier (for multiplying, in the time domain, or convoluting, in the frequency domain) the output signals from the volume control module 36 and tone control module 38. The output of the AND gate 70 is coupled to (or defines) the output 44 of the enunciator 30.

The divider 40 is also coupled to the output of the AND gate 68, to receive a clock signal. The divider also receives a control signal 50 for controlling the divider value, in accordance with well known programmable divider principles. The output of the divider 40 is provided as the data input of the data pattern register 66. The register 66 also has an input coupled, through a switch 67, for receiving a data pattern control signal 52 from suitable control electronics (such as a processor 32 under the control of a program stored in ROM 33, as shown in FIG. 1) for controlling the shift pattern of data in the register.

Once a data pattern has been loaded into the register 66 through the data pattern control signal input, the switch 67 is operated to connect that input of the register to a feedback control loop 68 to cause continued shifting of the data pattern within the register during operation and, thus, to provide a shift register arrangement for constantly outputting the same overtone pattern at the desired frequency during operation. As noted above, the output of the shift register 66 is coupled to one input of the second AND gate 70.

Figure 6:
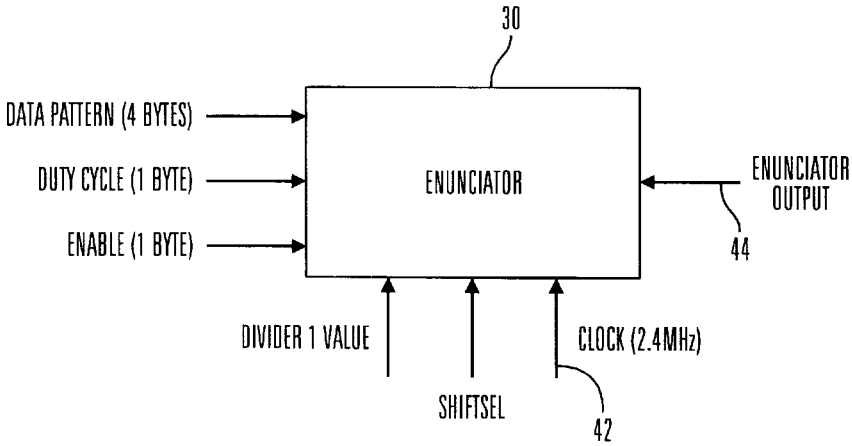
FIG. 6 is a block diagram representation of an enunciator of FIG. 5, implemented in a single integrated circuit chip.
Figure 7A:
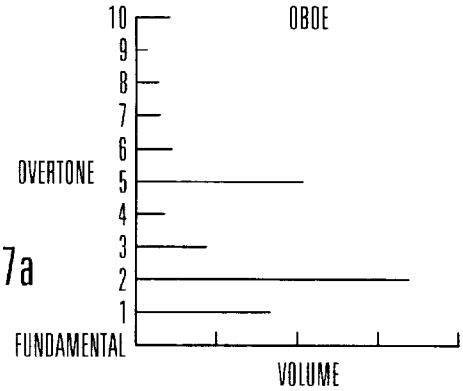
FIGS. 7*a*–7*f* are graphical representations of various overtone patterns.
Figure 7B:
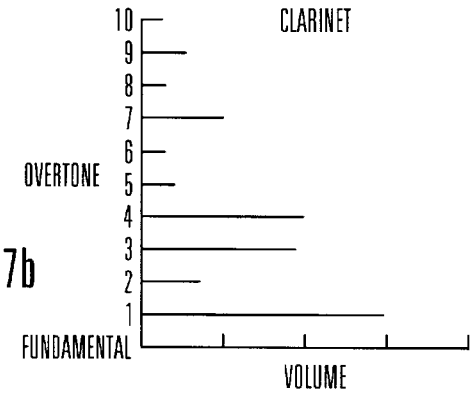
Figure 7C:
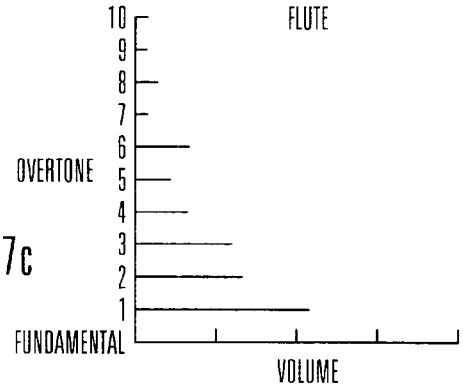
Figure 7D:
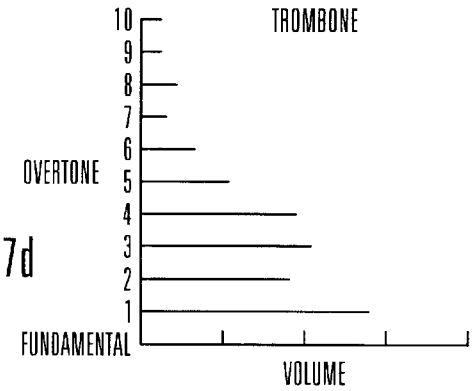
Figure 7E:
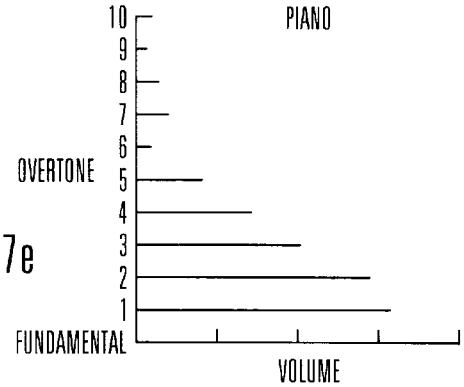
Figure 7F:
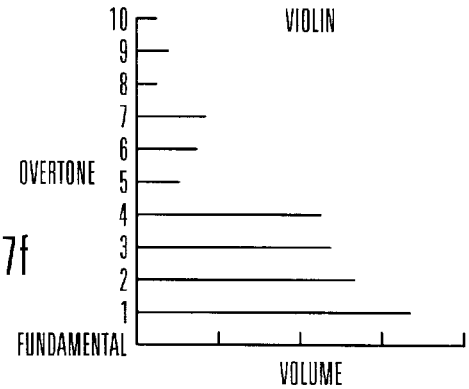
Figure 8:
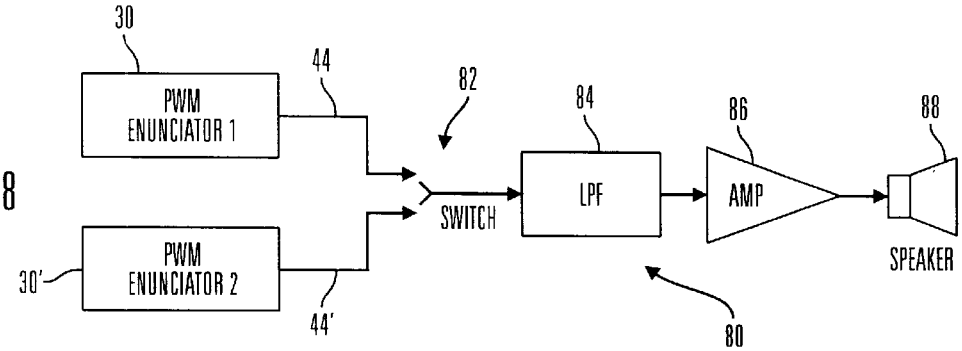
FIG. 8 is a block diagram representation of a multi-tone enunciator arrangement.

While the clock signal frequency at the input 42 and the size and capacity of various components such as the counter 60, register 62, divider 40 and shift register 66 may be selected to accommodate the particular application of use, in one preferred embodiment for cellular telephone systems, the input clock signal frequency at input 42 may be, for example, about 2.4 MHz, the counter 60 may be an 8-bit counter, the register 62 may be an 8-bit (or 1 byte) register, the divider 40 may be a 10-bit programmable divider and the shift register 66 may be a 4-byte register. It will be understood that other embodiments may employ other suitable clock frequencies and component bit capacities. In one preferred embodiment, the enunciator shown in FIG. 5 is implemented on a single integrated circuit chip, as shown in FIG. 6. However, other embodiments may employ multiple integrated circuits or discrete components coupled in a manner consistent with the present invention.

In the above-referenced embodiment, the 2.4 MHz clock input signal allows the enunciator to generate one or more tones within the range of 200 Hz to 500 Hz. The 8-bit counter 60 is an up counter, which outputs an 8-bit value (between 1 and 100) at a frequency of 2.4 MHz, to compare with the duty cycle signal. At a clock rate of 2.4 MHz, the up counter will output an 8-bit number every clock cycle from 1 to 100, incrementing by 1 for every clock cycle. The counter 60 may reset to 0 when a count of 100 has been reached. Thus, for the nth clock cycle, the output number is Mod(n,100), which is compared with the duty cycle stored in the duty cycle register.

The comparator compares the counter value with the duty cycle signal (between 1 and 99). If the counter value is less than or equal to the duty cycle signal, the Pmod output 37 of the comparator is "1." Otherwise, the Pmod output 37 of the comparator is "0." In this regard, with a clock frequency of 2.4 MHz, the Pmod output 37 of the comparator is a continuous pulse train signal of 24 KHz, which is the frequency of the input clock divided by 100, the period to reset counter 60. The Pmod output 37 of the comparator is used to modulate the Ptone signal 39 output of the tone control module 39. The Pmod output 37 is a pulse with variable width to reflect the duty cycle. To adjust the duty cycle by, for example, one percent, the up counter is provided with the capability to count from 1 to 100. Thus, the Pmod output 37 of the volume control module 36 preferably comprises a pulse train at a prescribed frequency (for example approximately 24 KHz) and duty cycle ranges preferably from 1% to 99% (or minimally 5% to 95%).

The programmable divider 40 provides signal having a frequency within, for example, the 200 Hz to 500 Hz range, depending upon the divider value control signal 50. Other frequencies may be employed in further embodiments. However, the 200 Hz to 500 Hz range corresponds to fundamental frequencies of pleasing tones (notes) that are within the typical human hearing range. The divider 40 is preferably provided with the capabilities to provide a plurality of different frequency output signals from the input clock signal, depending upon the divider control signal 50.

The data pattern shift register 66 provides fine tuning of the tonal qualities of the sound signal, based on specific data patterns defined by the user. More particularly, the data pattern shift register 66 stores one of plural data patterns specified by the user, to generate different tonal qualities. For example one data pattern may result in tonal qualities simulating a first type of musical instrument (such as a flute), while another data pattern may result in tonal qualities simulating another type of musical instrument (such as a violin).

Each data pattern corresponds to the pattern of relative intensities of harmonic or overtone frequencies $f_1, f_2 \ldots f_n$ relative to the intensity of the fundamental frequency $f_0$. In electronic sound signals, different patterns of relative intensities of the overtone frequencies relative to the fundamental frequencies result in different tonal qualities. Such patterns can be selected to simulate tonal qualities of, for example, well known musical instruments. Thus, the mix of overtones of the sound of an oboe would be different from that of a clarinet. Such patterns are within the scope of one skilled in the art. For example, FIGS. 6*a* through 6*f* show example overtone patterns for an oboe, clarinet, flute, trombone, piano and violin, respectively. Of course, further embodiments of the invention may employ overtone patterns for simulating other instruments or other tonal qualities.

The Shift Select input to the shift register 66 controls the switch toggle between load and shift operations. The output of the shift register 66 comprises a continuous pulse train Ptone having a frequency within the audio band (20 Hz to 20 KHz) and a tonal quality dependent upon the selected overtone pattern effected by the shift register settings (as controlled by the data pattern control signal 52).

Thus, the Ptone output 39 of the tone control module 38 comprises a relatively low frequency pulse for controlling tone quality, while the Pmod output 37 of the volume control module 36 comprises a relatively high frequency pulse for controlling the volume (related to duty cycle) of the electronic sound signal at output 44. In preferred embodiments, the Ptone signal is modulated by the Pmod signal, by the AND function of the second AND gate 70 (FIG. 5). The resulting signal at output 44 is preferably provided to a low pass filter, so that the ratio of harmonics and fundamental frequencies of a tone will not change when changing volume.

According to a further embodiment of the present invention, a multi-tone enunciator is implemented with a plurality of enunciators 30 as described above, each providing an output signal corresponding to a different tone with respect to the output signal of each other enunciator in the plurality. Thus, for example, a dual-tone enunciator system 80 is shown in FIG. 7, wherein two enunciators 30 and 30' are coupled, through a switch 82 to a low pass filter 84, the output of which is coupled to an amplifier 86 and speaker 88. The enunciators 30 and 30' function, as discussed above, but are controlled to provide electronic sound signals at outputs 44 and 44', respectively, corresponding to two different tones. The switch 82 is operated to switch between signals outputs 44 and 44' at a rate fast enough to be unnoticeable to the ordinary human, such that the signal provided to the filter 84, amplifier 86 and speaker 88 arrangement produces an audible sound from the speaker 88 which is heard by the user as a combination of two tones played simultaneously.

Other embodiments may employ any suitable number of enunciators to produce sounds that are heard as the corresponding number of tones, simultaneously. In this manner, chords, composed of multiple tones or notes, may be produced. Furthermore, one or more enunciators may be controlled, as discussed above, to provide varying tones over a period of time, such that a sequence of notes, chords or combinations thereof may be played over a period of time, to effect a tune or song.

Thus, embodiments described above employ an input clock signal and generate, therefrom, an output electronic sound signal having defined volume and tone characteristics. As discussed above, in preferred embodiments the volume and tone characteristics may be controlled (programmed) by control signals provided by suitable control electronics, such as processor 33. In further embodiments, the volume control module may be preset to provide a particular volume control signal 37, based on a given clock input frequency.

What is claimed is:

1. An enunciator for receiving a periodic input signal and producing an electronic sound signal, comprising:

a volume control module for receiving a first periodic signal and providing a volume control signal comprising a second periodic signal having a specified frequency and duty cycle;

a divider having an input for receiving the first periodic signal and providing a corresponding output signal having a frequency corresponding to the frequency of the first periodic signal frequency divided by a divider value;

a tone control module coupled to the divider, for providing a tone control signal comprising a third periodic signal having a specified frequency and overtone pattern, comprising a data pattern shift register having a data input coupled to the output of the divider and an output for providing a tone control signal; and a modulator for modulating the third periodic signal by the second periodic signal to provide an electronic sound signal.

2. An enunciator as recited in claim 1, wherein the divider comprises a programmable divider having a control input for receiving a divider value control signal for determining the divider value associated with the divider.

3. An enunciator as recited in claim 1, wherein the first periodic signal comprises a clock signal.

4. An enunciator as recited in claim 1, wherein the volume control module comprises:

a counter for receiving the first periodic signal, said counter having a counter output; and a comparator having at least one first input coupled to the counter output and at least one second input coupled to receive the first periodic signal, the comparator further having an output for providing the volume control signal.

5. An enunciator as recited in claim 4, wherein the modulator comprises an AND gate configuration.

6. An enunciator as recited in claim 1, wherein the modulator comprises an AND gate configuration.

7. An enunciator as recited in claim 1, wherein the data input for receiving a data pattern control signal contains a switchably controlled input for alternatively receiving a data pattern signal and the output of the data pattern shift register.

8. A receiver in a communication system for receiving communication signals transmitted over a transmission channel, comprising:

signal receiving electronics operative coupled to the transmission channel for receiving communication signals directed to the receiver;

a controller, responsive to the receipt of a communication signal by the signal receiving electronics, to provide an enunciator enable signal;

a clock signal generator for generating a clock signal defining a clock frequency and duty cycle; and an enunciator coupled to the clock signal generator, for producing an electronic sound signal, the enunciator comprising:

a volume control module for receiving a first periodic signal and providing a volume control signal comprising a second periodic signal having a specified frequency and duty cycle;

a divider for receiving the first periodic signal and providing a corresponding output signal having a frequency corresponding to the frequency of the first periodic signal frequency divided by a divider value;

a tone control module coupled to the divider, for providing a tone control signal comprising a third periodic signal having a specified frequency and overtone pattern, comprising a data pattern shift register having a data input coupled to the output of the divider and an output for providing a tone control signal; and a modulator for modulating the third periodic signal by the second periodic signal to provide an electronic sound signal.

9. A receiver as recited in claim 8, further comprising a sound producing device coupled to the modulator to produce an audible sound from the electronic sound signal.

10. A receiver as recited in claim 8, wherein the divider comprises a programmable divider having a control input for receiving a divider value control signal for determining the divider value associated with the divider.

11. A receiver as recited in claim 8, wherein the first period signal comprises a clock signal.

12. A receiver as recited in claim 8, wherein the volume control module comprises:

a counter for receiving the first periodic signal and having a counter output; and a comparator having at least one first input coupled to the counter output and at least one second input coupled to receive the first periodic signal, the comparator further having an output for providing the volume control signal.

13. A receiver as recited in claim 12, wherein the modulator comprises an AND gate configuration.

14. A receiver as recited in claim 8, wherein the modulator comprises an AND gate configuration.

15. A receiver as recited in claim 8, wherein the data input for receiving a data pattern control signal contains a switchably controlled input for alternatively receiving a data pattern signal and the output of the data pattern shift register.

16. A process of generating an electronic sound signal, comprising:

generating a variable duty cycle signal from a clock signal;

generating a tone control signal from the clock signal; and modulating the variable duty cycle signal by the tone control signal to provide an electronic sound signal, wherein generating the tone control signal comprises:

dividing the clock signal frequency by a programmable divide value to provide a divider output signal having a frequency within the audible range;

providing the divider output signal to a pattern shift register set for controlling the overtone pattern of the divider output signal and for providing and output tone control signal having a frequency within the audible range and an overtone pattern prescribed by the setting of the pattern shift register; and combining the tone control signal with the variable duty cycle signal to produce a digital enunciator output representing both the desired tone and desired volume level.

17. A process as recited in claim 14, wherein the step of generating a volume control signal comprises:

inputting the clock signal to a counter to provide a counter output; and comparing the counter output to the clock signal to produce a comparison signal defining the volume control signal.

* * * * *